United States Patent [19]

Schwind et al.

[11] Patent Number: 4,792,410

[45] Date of Patent: Dec. 20, 1988

[54] LUBRICANT COMPOSITION SUITABLE FOR MANUAL TRANSMISSION FLUIDS

[75] Inventors: James J. Schwind, Willowick; Craig D. Tipton, Perry, both of Ohio

[73] Assignee: The Lubrizol Corporation, Wickliffe, Ohio

[21] Appl. No.: 946,407

[22] Filed: Dec. 22, 1986

[51] Int. Cl.[4] ..... C10M 135/10

[52] U.S. Cl. ..... 252/38; 252/41; 252/39

[58] Field of Search ..... 252/33.4, 41, 42.7, 252/38, 39, 33.2, 77

[56] References Cited

U.S. PATENT DOCUMENTS

| | | | |
|---|---|---|---|
| 3,480,548 | 11/1969 | Hellmuth | 252/33.4 |
| 3,679,584 | 7/1972 | Hellmuth | 252/33.4 |
| 3,779,920 | 12/1973 | Devries | 252/33.4 |
| 3,929,650 | 12/1975 | King | 252/33.4 |
| 3,944,495 | 3/1976 | Wiley et al. | 252/75 |
| 3,957,664 | 5/1976 | Heilman et al. | 252/59 |
| 4,031,023 | 6/1977 | Musser et al. | 252/48.2 |
| 4,119,549 | 10/1978 | Davis | 252/45 |
| 4,119,550 | 10/1978 | Davis et al. | 252/45 |
| 4,172,855 | 10/1979 | Shubkin et al. | 585/16 |
| 4,191,659 | 3/1980 | Davis | 252/45 |
| 4,253,977 | 3/1981 | O'Hallorah | 252/42.7 |
| 4,344,854 | 8/1982 | Davis et al. | 252/45 |
| 4,505,830 | 3/1985 | Vinci | 252/33 |
| 4,525,289 | 6/1985 | Howie | 252/49.9 |
| 4,529,528 | 7/1985 | Horodysky | 252/49.6 |

FOREIGN PATENT DOCUMENTS

| | | |
|---|---|---|
| 0075411 | 3/1983 | European Pat. Off. . |
| 0157969 | 4/1984 | European Pat. Off. . |
| 0152677 | 10/1984 | European Pat. Off. . |
| WO87/05927 | 10/1987 | PCT Int'l Appl. . |

*Primary Examiner*—William R. Dixon, Jr.
*Assistant Examiner*—J. Hunter
*Attorney, Agent, or Firm*—Forrest L. Collins; J. Walter Adams; Roger Y. K. Hsu

[57] ABSTRACT

A lubricant mixture suitable for a manual transmission fluid comprising:

(a) a boronated overbased alkali metal or alkaline earth metal salt selected from the group consisting of sulfonates, phenates, oxylates, carboxylates and mixtures thereof;

(b) a friction modifier selected from the group consisting of fatty phosphites, fatty acid amides, borated fatty epoxides, fatty amines, glycerol esters and their borated derivatives, borated alkoxylated fatty amines, sulfurized olefins and mixtures thereof;

(c) and an oil of lubricating viscosity, wherein such lubricants have excellent static and dynamic frictional characteristics. The lubricant fluids are particularly useful in reducing double detent and clashing during manual transmission shifting.

17 Claims, No Drawings

LUBRICANT COMPOSITION SUITABLE FOR MANUAL TRANSMISSION FLUIDS

BACKGROUND OF THE INVENTION

1. Field of the Invention

This invention relates to a lubricating composition, and, in particular, to manual transmission fluids.

2. Description of the Art Practices

Transmission fluids, particularly those for synchromesh manual transmissions, have typically been based upon fluids described for other purposes such as engine oils, differential oils and automatic transmission fluids. The lighter of these oils, e.g., automatic transmission fluid, thins out too much at the high temperatures reached during summertime driving resulting in objectional gear noise or hot rattle. While the heavier of these oils are acceptable under normal summertime driving conditions, difficulties are often encountered in cold weather conditions. The viscosity of the heavier mineral oils increases substantially in the winter due to low temperatures. The shifting characteristics for the manual transmission are then significantly hindered due to the thickened oil.

A second problem which faces a synchromesh transmission is that of double detent or double bump. This phenomena results when the static coefficient of friction is too high and the engaging sleeve chamfer cannot engage readily with the cone chamfer due to insufficient slippage to allow smooth engaging. A further problem arises if the dynamic coefficient of friction is too low as clashing is observed. The clashing arises because the relative velocity of the blocker ring and cone assembly does not go to zero as engagement proceeds.

Given a resurgence of manual transmissions in an attempt to conserve fuel and in high performance vehicles using manual transmissions, it becomes imperative that the problems of double detent, low temperature shift effort and clashing be solved. The present invention provides a solution to double detent, clashing and shift effort through the formulation of a manual transmission fluid which exhibits high dynamic friction properties as well as low static friction properties and through temperature viscosity controls.

U.S. Pat. No. 4,031,023 issued June 21, 1977 to Musser and Koch, discloses the use of viscosity improvers to impart a liquid character to a lubricating composition. Musser et al also discloses synthetic lubricating oils, extreme pressure (EP) agents and dispersants. The term dispersants as utilized by Musser et al include materials which suspend or disperse sludge and which are described as being oil-soluble, and stably dispersible in lubricating compositions.

Heilman et al in U.S. Pat. No. 3,957,664 issued May 18, 1976, discuss the use of olefin based synthetic lubricants. In particular, internal olefins or mixtures of internal olefins are combined with di-t-butyl-p-cresol to obtain a high temperature lubricant.

U.S. Pat. No. 3,929,650 to King et al issued Dec. 30, 1975 discloses borated over-based alkali metal carbonates of alkali or alkaline earth metal sulfonates. U.S. Pat. No. 3,480,548 to Hellmuth et al issued Nov. 25, 1969 discloses overbased boronated products.

Wiley et al in U.S. Pat. No. 3,944,495 issued Mar. 16, 1976, discuss various di-alkyl dithiophosphates obtained from oxylated long, straight-chain alcohols, acids or mercaptans and the use of such materials in lubricating oils. Wiley et al is concerned with automatic transmission fluids and, in particular, zinc salts which are stated to give anti-corrossion and anti-wear properties to the automatic transmission.

U.S. Pat. No. 4,119,550 issued Oct. 10, 1978 to Davis and Holden describes sulfurized olefins as lubricant additives. A further disclosure of sulfurized olefins for use in lubricants is found in U.S. Pat. No. 4,119,549 issued Oct. 10, 1978 to Davis.

Further disclosures of sulfurized olefins for lubricant formulations are found in U.S. Pat. No. 4,344,854 to Davis et al issued Aug. 17, 1982. Still further disclosures of sulfurized products useful in lubricants are found in Davis, U.S. Pat. No. 4,191,659 issued Mar. 4, 1980.

The use of calcium alkyl benzene sulfonates and polyolefins in a lubricant is found in U.S. Pat. No. 4,172,855 issued Oct. 30, 1979 to Shubkin et al. Horodysky, in U.S. Pat. No. 4,529,528 issued July 16, 1985 describes borated amine-phosphite reaction products which are useful in lubricants and fuels. Horodysky also discloses various olefin polymers which are stated to be useful in synthetic oils.

Howie et al, in U.S. Pat. No. 4,525,289 issued June 25, 1985, discloses various lubricating formulations utilizing overbased calcium sulfonate and overbased magnesium sulfonate. Trimers of alpha-decene are shown in combination with the sulfonate salts and as well with dispersants, foam inhibitors and amides in Howie et al.

The foregoing references, while generally applicable to lubricating compositions, do not specifically discuss the issue of obtaining good dynamic and static properties in a manual transmission fluid. The present invention deals with obtaining a manual transmission fluid having outstanding static and dynamic frictional properties.

Throughout the specification and claims, percentages and ratios are by weight, temperatures are in degrees Celsius, and pressures are in KPascals over ambient unless otherwise indicated. To the extent that references cited in the specification are relevant to the present invention, they are herein incorporated by reference.

SUMMARY OF THE INVENTION

The present invention describes a lubricant mixture suitable for a manual transmission fluid comprising:

(a) a boronated overbased alkali metal or alkaline earth metal salt selected from the group consisting of sulfonates, phenates, oxylates, carboxylates and mixtures thereof;

(b) a friction modifier selected from the group consisting of fatty phosphites, fatty acid amides, borated fatty epoxides, fatty amines, glycerol esters and their borated derivatives, borated alkoxylated fatty amines, sulfurized olefins and mixtures thereof;

(c) and an oil of lubricating viscosity. The invention also discloses a concentrate containing about 95% to about 50% by weight of a mixture of (a), (b) and (c) wherein:

(a) is a borated overbased alkali metal or an alkaline earth metal salt selected from the group consisting of sulfonates, phenates, oxylates, carboxylates and mixtures thereof;

(b) is a friction modifier selected from the group consisting of fatty phosphites, fatty acid amides, borated fatty epoxides, fatty amines, glycerol esters and their borated derivatives, borated alkoxylated fatty amines, sulfurized olefins and mixtures thereof; and (c) from about 5% to about 50% by weight of an oil of lubricating viscosity.

DETAILED DESCRIPTION OF THE INVENTION

The first aspect of the present invention is the borated over-based alkali metal or alkaline earth metal salt which has been found particularly useful to assist in the frictional properties in the manual transmission fluid compositions. The salt may be a phenate, oxylate, carboxylate or preferably a sulfonate. It has been determined that the preferred salt is a sodium sulfonate, thereafter the preference is for a potassium, calcium, or magnesium salt.

The sulfonate salts are those having a substantially oleophilic character and which are formed from organic materials. Organic sulfonates are well known materials in the lubricant and detergent arts. The sulfonate compound should contain on average from about 10 to about 40 carbon atoms, preferably from about 12 to about 36 carbon atoms and preferably from about 14 to about 32 carbon atoms on average. Similarily, the phenates, oxylates and carboxylates have a substantially oleophilic character.

While the present invention allows for the carbon atoms to be either aromatic or in a paraffinic configuration, it is highly preferred that alkylated aromatics be employed. While naphthalene based materials may be employed, the aromatic of choice is the benzene moiety.

The most preferred composition is thus a monosulfonated alkylated benzene, and is preferably the monoalkylated benzene. Typically, alkyl benzene fractions are obtained from still bottom sources and are mono- or di-alkylated. It is believed, in the present invention, that the mono-alkylated aromatics are superior to the dialkylated aromatics in overall properties.

It is desired that a mixture of mono-alkylated aromatics (benzene) be utilized to obtain the mono-alkylated salt (benzene sulfonate) in the present invention. The mixtures wherein a substantial portion of the composition contains polymers of propylene as the source of the alkyl groups assists in the solubility of the salt in the manual transmission fluid. The use of mono-functional (e.g., mono-sulfonated) materials avoids crosslinking of the molecules with less precipitation of the salt from the lubricant.

The amount of the salt utilized in the present invention is typically from about 0.5% to about 8%, preferably from about 0.75% to about 6%, and most preferably from about 1% to about 5% by weight of the total composition. For maximum effectiveness, the salt should be greater than 3% by weight of the composition.

It is also desired that the salt be "overbased". By overbasing, it is meant that a stoichiometric excess of the metal be present over that required to neutralize the anion of the salt. The excess metal from overbasing has the effect of neutralizing acids which may build up in the lubricant. A second advantage is that the overbased salt increases the dynamic coefficient of friction. Typically, the excess metal will be present over that which is required to neutralize the anion at about 10:1 to 30:1, preferably 11:1 to 18:1 on an equivalent basis.

The alkali metal borate dispersion may be prepared by the following steps: a suitable reaction vessel is charged with the alkali metal carbonate overbased metal sulfonate within the oleophilic reaction medium (typically the hydrocarbon medium employed to prepare the overbased metal sulfonate). The boric acid is then charged to the reaction vessel and the contents vigorously agitated.

The reaction is conducted for a period of 0.5 to 7 hours, usually from 1 to 3 hours at a reaction temperature of 20° to 200° C., preferably from 20° to 150° C. and more preferably from 40° to 125° C. At the end of the reaction period, the temperature is raised to 100° to 250° C., preferably from 100° to 150° C. to strip the medium of any residual alcohol and water. The stripping may be done at atmosphere pressure or under reduced pressure of 93 KPa to 1 KPa Hg.

The amount of boric acid charged to the reaction medium depends upon what type of alkali metal borate is desired. If a tetraborate is desired 2 molar parts of boric acid are charged per molar equivalent of overbased alkali metal (e.g., 4 molar parts of boric acid for each molar part of sodium carbonate). Generally, from 1 to 3 molar parts of boric acid are charged to the reaction medium for each molar equivalent part of overbased alkali metal.

The amount of alkali metal borate which may be present in the oleophilic lubricating oil may vary from 0.1 to 65 weight percent depending on whether a concentration or final lubricant is desired. Generally, for concentrates, the borate content varies from 20 to 50 weight percent, and preferably from 35 to 45 weight percent. For lubricants, the amount of borate generally varies from 0.1 to 20 weight percent and preferably from 4 to 15 weight percent.

The borate dispersions are conveniently sodium or potassium metaborates, having from 0 to 8 waters of hydration (preferably 1 to 5) and prepared from an overbased sodium, potassium, calcium or barium petroleum sulfonate. Particularly preferred is a borate dispersion of sodium metaborate having 0 to 2 waters of hydration and prepared from an overbased calcium sulfonate.

The alkali metal tetraborates are prepared from an overbased metal sulfonate and converted into a metaborate by the subsequent reaction with two molar parts of an alkali metal hydroxide per molar part of said alkali metal tetraborate. This is the preferred method for preparing the metaborates since a charge ratio of one molar part of boric acid per molar equivalent part of metal carbonate in the overbased sulfonate tends to form a mixture predominantly a metal tetraborate and overbased metal carbonate. The reaction conditions may be the same as that described for the preparation of the alkali metal carbonate overbased alkali or alkaline earth metal sulfonate.

A preferred boronated product useful herein may be obtained from a process for obtaining a high carbonate content borated product comprising:

(a) mixing an overbased sulfonate and any required inert liquid medium, (b) borating the mixture (a) with a borating agent at a temperature less than that at which substantial foaming occurs, (c) raising the temperature of the mixture (b) to that temperature in excess of the boiling point of water within the mixture (b), (d) separating substantially all of the water from the reaction mixture (c) while retaining substantially all of the carbonate in the mixture (c) and, (e) recovering the product (d) as a high carbonate content borated product.

A process for obtaining a high carbonate content overbased borated product containing at least about 5% by weight of carbon dioxide wherein the product is obtained by:

(a) mixing an overbased component and any required inert liquid medium, (b) reacting component (a) in the presence of a borating agent to a boron content of at least about 3% by weight of the product, (c) reducing the water content of the product (b) to less than about 3% by weight and, (d) recovering the high carbonate content overbased borated product.

The products of the above processes as well as an overbased borated product having a mean particle diameter of less than about 9 microns is also described as follows.

A. The Overbased Material. The overbased components utilized herein are any of those materials typically utilized for lubricating oils or greases. The anion of the overbased component is typically a sulfonate, phenate, carboxylate, phosphate or similar material. Especially preferred herein are the anionic portions which are sulfonates. Typically the useful sulfonates will be mono- or di-hydrocarbyl substituted aromatic compounds. Such materials are typically obtained from the by-products of detergent manufacture. The products are conveniently mono- or di-sulfonated and the hydrocarbyl substituted portion of the aromatic compound are typically alkyls containing about 10 to 30, preferably about 14 to 28 carbon atoms.

The cationic portion of the overbased material is typically an alkali metal or alkaline earth metal. The commonly used alkali metals are lithium, potassium and sodium, with sodium being preferred. The alkaline earth metal components typically utilized are magnesium, calcium and barium with calcium and magnesium being the preferred materials.

The overbasing is accomplished utilizing an alkaline earth metal or alkali metal hydroxide. The overbasing is accomplished by utilizing typically any acid which may be bubbled through the component to be overbased. The preferred acidic material for overbasing the components of the present invention is carbon dioxide as it provides the source of carbonate in the product. As it has been noted that the present invention utilizes conventionally obtained overbased materials, no more is stated within this regard.

The preferred overbasing cation is sodium and the overall preferred product is a borated sodium carbonate overbased sodium sulfonate. A second preferred product herein is a borated sodium carbonate overbased calcium sulfonate.

The overbasing is generally done such that the metal ratio is from about 1.05:1 to about 50:1, preferably 2:1 to about 30:1 and most preferably from about 4:1 to about 25:1. The metal ratio is that ratio of metallic ions on an equivalent basis to the anionic portion of the overbased material.

B. The Inert Liquid Medium

The inert liquid medium when utilized to obtain the borated product facilitates mixing of the ingredients. That is, the overbased materials tend to be rather viscous especially when the alkaline earth metal components are utilized. Thus, the inert liquid medium serves to disperse the product and to facilitate mixing of the ingredients. The inert liquid medium is typically a material which boils at a temperature much greater than that of water and which is useful in the end product for which the invention is intended.

Typically, the inert liquid medium is a member selected from the group consisting of aromatics, aliphatics, alkanols and mineral oil and mixtures thereof. The aromatics utilized are typically benzene or toluene while the aliphatics are materials having from about 6 to about 600 carbon atoms. The alkanols may be mono- or di-alkanols and are preferably those materials which have limited water solubility. Typically, alkanols containing 10 or less carbon atoms are useful herein. Mineral oil, when used as the inert liquid medium is as typically defined by the ASTM standards.

The inert liquid medium may be omitted where, for example, the product is extruded. In such cases mechanical mixing replaces the need for a solvent.

C. The Carbon Dioxide Component. The carbon dioxide content of product (d) is typically greater than about 5% by weight. It is desirable that the carbon dioxide content of product (d) be between 5.5% and about 12% by weight. The weights given herein are by weight of the total product including the inert medium. The carbon dioxide content of the products is obtained by acidifying the product to liberate all of the $CO_2$ in the product. For purposes herein, the terms carbon dioxide and carbonate are identical. That is, the carbonate is the chemically incorporated form of the carbon dioxide and the latter is the compound used to specify the amount of carbonate in the product. Thus, the ratios expressed herein use the molecular weight (44) of carbon dioxide.

D. The boronating agent is conveniently orthoboric acid. Also useful herein are boron halides such as boron trifluoride, polymers of boric acid, boron anhydride, boron esters, and similar materials. The boron content of the products of the present invention is typically greater than 3%, preferably greater than 4% and most preferably greater than 5% by weight of the product. It is also desirable that the weight percent of carbon dioxide in the product (d) is at least 50% by weight of the boron in product (d). Preferably, the present carbon dioxide to the percent boron is greater than 75% and most preferably greater than 100% by weight of the boron.

E. The water content of the product when it is finished is typically less than 3% by weight. At levels much greater than 2% by weight substantial amounts of the boron can be lost by forming boron compounds which are soluble in the water and which are separated off. If the separation does not occur during processing, then during storage, the boron content may be diminished by having unacceptably high levels of water in the product. More preferably, the water content of the product is less than 1% by weight and most preferably less than 0.75% by weight.

F. The Processing. The products herein are conventionally obtained up to the point where the boron incorporation occurs. That is, the boronation aspect to obtain the alkali metal or alkaline earth metal overbased sulfonate is downstream from the carbonation facility. If desired, carbonation may continue; however, such is not necessary and hinders the boronation in addition to raising the cost of the product.

The mixture (a) as defined above is treated at (b) at a temperature less than that at which substantial foaming occurs. Such temperature is typically less than 110° C., more preferably less than 99° C., and most preferably between about 66° C. and about 88° C. It is also desirable that the temperature is raised during the boronation but not raised so rapidly as to cause substantial foaming. Not only does the foaming cause a loss of head space in the reaction vessel with a concomitant blocking of reaction ports but the product is not believed to be the same if it is rapidly liberated of carbon dioxide. That is, there is an exchange reaction occurring between the carbon dioxide portion of the overbased material and the boronating agent wherein boron polymers are incorporated into the overbased material. Thus, the boronation is allowed to occur without substantial foaming until the point where substantially no more boron is taken up by the overbased material.

At the point where the boron is substantially chemically incorporated within the overbased material, the temperature is then raised to a point in excess of the boiling point of water within the mixture (b). Such temperatures are typically in excess of 100° C. as the water tends to separate rapidly from the reaction mass at that temperature. Conveniently, the temperature for removing the water is between about 120° C. and 180° C. As the boronation is substantially complete and the carbon dioxide content of the product is stable, substantial foaming is avoided at the point where the water is taken from the product. Thus, little carbon dioxide will be liberated between steps (c) and (d). The temperature conditions are typically not lowered substantially during steps (c) and/or (d), especially during (c).

The product is typically recovered as the high carbonate content borated product by allowing the product to cool, followed by suitable packaging. Of course, the product is slightly hygroscopic due to the high inorganic content and, thus, protective packaging is recommended. The product (d) may also be recovered by transferring it for downstream processing such as mixing it with additional materials such as an oil of lubricating viscosity or other desired components for a lubricant or a grease. A significant advantage in practicing the present invention is that the boronation is brought about without alternatively raising and lowering the temperature, especially during segmental addition of the boronating agent.

It is desired that the mean particle diameter of the products obtained herein is less than 9 microns, preferably less than 8 microns and most preferably less than 5 microns. Preferably, the particle size distribution is such that substantially all of the particles are less than 9 microns, more preferably less than 8 microns and most preferably less than 5 microns. Thus, the products obtained herein are substantially different than those known in the art in that the fine particle size obtained herein allows effective dispersion in an oil or grease thereby giving effective protection for the metal surfaces with which the product is brought into contact. General guidance in determining the particle size herein is found in the *Textbook of Polymer Science* by Billmeyer, fourth printing, March, 1966, Library of Congress Catalog Card No. 62-18350.

The second required component of the is a friction modifier such as a fatty phosphite. The phosphites are generally of the formula $(RO)_2PHO$. The preferred dialkylated phosphite as shown in the preceding formula is typically present with a minor amount of monoalkylated phosphite of the formula (RO)(HO)PHO.

In the above structure of the phosphite, the term "R" has been referred to as an alkyl group. It is, of course, possible that the alkyl is alkenyl and thus the terms "alkyl" and "alkylated", as used herein, embrace other than saturated alkyl groups within the phosphite. The phosphite utilized herein is thus one having sufficient hydrocarbyl groups to render the phosphite substantially oleophilic and further that the hydrocarbyl groups are preferably substantially unbranched.

It is preferred that the phosphite contain from about 8 to about 24 carbon atoms in each of the fatty radicals described as "R". Preferably, the fatty phosphite contains from about 12 to about 22 carbon atoms in each of the fatty radicals, most preferably from about 16 to about 20 carbon atoms in each of the fatty radicals. It is highly preferred that the fatty phosphite be formed from oleyl groups, thus having 18 carbon atoms in each fatty radical.

Other friction modifiers which are useful herein are borated fatty epoxides, borated glycerol monocarboxylates, and borated alkoxylated fatty amines. Borated fatty epoxides are known from Canadian Pat. No. 1,188,704 issued June 11, 1985 to Davis. The oil-soluble boron-containing compositions of Davis are prepared by reacting at a temperature from about 80° C. to about 250° C., (A) at least one of boric acid or boron trioxide with (B) at least one epoxide having the formula $$R^1R^2C[O]CR^3R^4$$

wherein each of $R^1$, $R^2$, $R^3$ and $R^4$ is hydrogen or an aliphatic radical, or any two thereof together with the epoxy carbon atom or atoms to which they are attached, form a cyclic radical, said epoxide containing at least 8 carbon atoms.

As will be apparent, the borated fatty epoxides are characterized by the method for their preparation which involves the reaction of two materials. Reagent A may be boron trioxide or any of the various forms of boric acid, including metaboric acid ($HBO_2$), orthoboric acid ($H_3BO_3$) and tetraboric acid ($H_2B_4O_7$). Boric acid, and especially orthoboric acid, is preferred.

Reagent B is at least one epoxide having the above formula and containing at least 8 carbon atoms. In the formula, each of the R values is most often hydrogen or an aliphatic radical with at least one being an aliphatic radical containing at least 6 carbon atoms. The term "aliphatic radical" includes aliphatic hydrocarbon radicals (e.g., hexyl, heptyl, octyl, decyl, dodecyl, tetradecyl, stearyl, hexenyl, oleyl), preferably free from acetylenic unsaturation; substituted aliphatic hydrocarbon radicals including substituents such as hydroxy, nitro, carbalkoxy, alkoxy and alkylthio (especially those containing a lower alkyl radical; i.e., one containing 7 carbon atoms or less); and hetero atom-containing radicals in which the hetero atoms may be, for example, oxygen, nitrogen or sulfur. The aliphatic radicals are preferably alkyl radicals, and more preferably those containing from about 10 to about 20 carbon atoms. Mixtures of epoxides may be used; for example, commercial available $C_{14-16}$ or $C_{14-18}$ epoxides and the like, wherein $R^1$ is a mixture of alkyl radicals having two less carbon atoms than the epoxide. Most desirably, $R^1$ is a straight-chain alkyl radical and especially the tetradecyl radical.

Further useful epoxides are those in which any two of the R radicals form a cyclic radical, which may be alicyclic or heterocyclic. Examples are n-butylcyclopentene oxide, n-hexylcyclohexene oxide, methylenecyclo-octene oxide and 2-methylene-3-n-hexyltetrahydrofuran oxide.

The borated fatty epoxides may be prepared by merely blending the two reagents and heating them at a temperature from about 80° to about 250° C., preferably from about 100° to about 200° C., for a period of time sufficient for reaction to take place. If desired, the reaction may be effected in the presence of a substantially inert, normally liquid organic diluent such as toluene, xylene, chlorobenzene, dimethylformamide or the like, but the use of such diluents is usually unnecessary. During the reaction, water is evolved and may be removed by distillation.

The molar ratio of reagent A to reagent B is generally between about 1:0.25 and about 1:4. Ratios between about 1:1 and about 1:3 are preferred, with 1:2 being an especially preferred ratio.

It is frequently advantageous to employ a catalytic amount of an alkaline reagent to facilitate the reaction. Suitable alkaline reagents include inorganic bases and basic salts such as sodium hydroxide, potassium hydroxide and sodium carbonate; metal alkoxides such as sodium methoxide, potassium t-butoxide and calcium ethoxide; heterocyclic amines such as piperidine, morpholine and pyridine; and aliphatic amines such as n-butylamine, di-n-hexylamine and tri-n-butylamine. The preferred alkaline reagents are the aliphatic and heterocyclic amines and especially tertiary amines. When the preferred method involving the "heel" is used, the alkaline reagent is typically added to the blend of the "heel" with reagent A.

The molecular structures of the compositions of this invention are not known with certainty. During their preparation, water is evolved in near-stoichiometric amounts for conversion of boric acid to boron trioxide when reagent A is boric acid, and gel permeation chromatography of the composition prepared from boric acid and a $C_{16}$ alpha-olefin oxide mixture in a 1:2 molar ratio indicates the presence in substantial amounts of three constituents having approximate molecular weights of 400, 600 and 1200.

The borated amines are generally known from European published application Nos. 84 302 342.5 filed Apr. 5, 1984 and 84 307 355.2 filed Oct. 25, 1984, both authored by Reed Walsh.

The borated amine friction modifiers are conveniently prepared by the reaction of a boron compound selected from the group consisting of boric acid, boron trioxide and boric acid esters of the formula $B(OR)_3$ wherein R is a hydrocarbon-based radical containing from 1 to about 8 carbon atoms and preferably from about 1 to about 4 carbon atoms with an amine selected from the group consisting of hydroxy containing tertiary amines corresponding to the formulae $$B\text{—}(OR^1)_xNR^2R^3 \quad (A)$$

and $$B\text{—}[(OR^1)_xZ]_3 \quad (B)$$

wherein Z is an imidazolene radical, $R^1$ in each formula is a lower alkylene based radical containing from 1 to about 8 carbon atoms, $R^2$ is a radical selected from the group consisting of hydrocarbon based radicals containing from 1 to about 100 carbon atoms and alkoxy radicals of the structure $H(OR^4)_y$— where $R^4$ is a lower alkylene based radical containing from 1 to about 8 carbon atoms, $R^3$ and $R^5$ (pendent from the ethylenic carbon in the 2 position in the imidazolene (Z) radical) are each hydrocarbon based radicals containing from 1 to about 100 carbon atoms, x and y are each an integer ranging from at least 1 to about 50 and the sum of x+y is at most 75.

In one embodiment, the amines useful in preparing the organo-borate additive compositions are those tertiary amines corresponding to (A) above wherein $R^2$ is an alkoxy radical of the structure $H(OR^4)_y$— wherein $R^4$ is a lower alkylene radical containing from 1 to about 8 carbon atoms and $R^3$ is an aliphatic based hydrocarbon radical containing from about 8 to about 25 carbon atoms, and preferably from about 10 to about 20 carbon atoms and x and y are each an integer ranging from at least 1 to about 25 and wherein the sum of x+y is at most 50, and those tertiary amines containing the imidazoline structure above wherein $R^1$ is a lower alkylene based radical containing from 1 to about 8 carbon atoms, $R^5$ is an aliphatic based hydrocarbon radical, preferably alkyl or alkenyl based radical, containing from about 8 to about 25 carbon atoms and preferably from about 10 to about 20 carbon atoms.

Preferred tertiary amines useful in preparing the multi-functional organo-borate additive compositions are those tertiary amines corresponding to formula (A) above wherein $R^2$ is an alkoxy radical of the structure $H(OR^4)_y$—, wherein $R^1$ and $R^4$ are individually ethylene or propylene radicals, $R^3$ is an alkyl or an alkenyl based hydrocarbon radical containing from about 10 to about 20 carbon atoms, x and y are each an integer ranging from at least 1 to about 9 and preferably from at least 1 to about 5 and the sum of x+y is at most 10 and preferably at most 5, i.e., the sum of x+y ranges from about 2 to about 10 and preferably from about 2 to about 5 respectively. Amines, per se, such as oleyl amines are useful as friction modifiers herein.

As used herein, the term "hydrocarbon-based radical" denotes a radical having a carbon atom directly attached to the remainder of the molecule and having predominantly hydrocarbon character within the context of this invention. Such radicals include the following:

(1) Hydrocarbon radicals; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like, as well as cyclic radicals wherein the ring is completed through another portion of the molecule (that is, any two indicated hydrocarbon radicals, e.g., $R^2$ and $R^3$, may together form an alicyclic radical and such radical may contain heteroatoms such as nitrogen, oxygen and sulfur). Such radicals are known to those skilled in the art; representative examples are examples of such radicals as represented by $R^2$, $R^3$ and $R^5$ in the formulae above include methyl, ethyl, butyl, hexyl, octyl, decyl, dodecyl, tetradecyl, octadecyl, eicosyl, cyclohexyl, phenyl and naphthyl and the like including all isomeric forms of such radicals and when $R^2$ and $R^3$ together form an alicyclic radical, then examples of such radicals include morpholinyl, piperidyl, piperazinyl, phenothiazinyl, pyrrolyl, pyrrolidyl, thiazolidinyl and the like.

(2) Substituted hydrocarbon radicals; that is, radicals containing non-hydrocarbon substituents which, in the context of this invention, do not alter the predominantly hydrocarbon character of the radical. Those skilled in the art will be aware of suitable substituents; representative examples are hydroxy (HO—); alkoxy (RO—); carbalkoxy ($RO_2C$—); acyl [RC(O)—]; acyloxy ($RCO_2$—); carboxamide ($H_2NC(O)$—); acylimidazyl; [RC(NR)—]; nitro(—$NO_2$); and alkylthio(RS—) and halogen atoms (e.g., F, Cl, Br and I).

Hetero radicals; that is, radicals which, while predominantly hydrocarbon, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based radical.

Terms such as "alkyl-based radical," "alkenyl-based radical" and alkylene-based radical" and the like have analogous meanings with respect to alkyl and aryl radicals and the like.

Representative examples of the tertiary amine compounds useful in preparing the organo-borate compounds of this invention include monoalkoxylated amines such as dimethylethanolamine, diethylethanolamine, dibutylethanolamine, diisopropylethanolamine, di(2-ethylhexyl)ethanolamine, phenylethylethanolamine, dibutylisopropanolamine, dimethylisopropanolamine and the like and polyalkoxylated amines such as methyldiethanolamine, ethyl-diethanolamine, phenyldiethanolamine, diethyleneglycol mono-N-morpholinoethyl ether, N-(2-hydroxyethyl)thiazoli-dine, 3-morpholinopropyl-(2-hydroxyethyl)cocoamine, N-(2-hydroxy-ethyl)-N-tallow-3-aminomethylpropionate, N-(2-hydroxyethyl)-N-tallow acetamide, 2-oleoylethyl(2-hydroxyethyl)tallowamine, N-[N'-dodecenyl]; N'-[2-hydroxy-ethylaminoethyl]thiazole, 2-methoxyethyl-(2-hydroxyethyl)tallowamine, 1-[N-dodecenyl; N-2-hydroxyethyl-aminoethyl]imidazole, N-[N'-octadecenyl-N'-2-hydroxyethyl-aminoethyl]phenothiazine, 2-hydroxydicocamine, 2-heptadecenyl-1-(2-hydroxyethylimidazoline, 2-dodecyl-1-(5-hydroxypentyl-imidazoline), 2-(3-cyclohexyl propyl)-1-(2-hydroxyethyl-imidazoline) and the like.

An especially preferred class of tertiary amines useful in preparing the organo-borate compounds of the invention is that constituting the commercial alkoxylated fatty amines known by the trademark "ETHOMEEN" and available from the Armak Company. Representative examples of these ETHOMEEN is ETHOMEEN C/12(bis[2-hydroxyethyl]cocoamine); ETHOMEEN C/20 (polyoxyethylene[10]cocoamine); ETHOMEEN S/12(bis[2-hydroxyethyl]soyamine); ETHOMEEN T/12(bis[2-hydroxyethyl]tallowamine); ETHOMEEN T/15(polyoxyethylene-[5]tallowamine); ETHOMEEN 0/12(bis[2-hydroxyethyl]oleyl-amine; ETHOMEEN 18/12(bis[2-hydroxyethyl]octadecylamine; ETHOMEEN 18/25 (polyoxyethylene[15]octadecylamine and the like. Of the various ETHOMEEN compounds useful in reparing the organo-borate additive compounds of the invention, ETHOMEEN T/12 is most preferred.

If desired, the tertiary amine reactants represented by formulae (A) and (B) above may be reacted first with elemental sulfur to sulfurize any carbon-to-carbon double bond unsaturation which may be present in the hydrocarbon based radicals $R^2$, $R^3$ and $R^5$ when these radicals are, for example, alkenyl radicals (e.g., fatty oil or fatty acid radicals). Generally the sulfurization reaction will be carried out at temperatures ranging from about 100° C. to about 250° C., and preferably from about 150° C. to about 200° C. The molar ratio of sulfur to amine can range from about 0.5:1.0 to about 3.0:1.0 and preferably 1.0:1.0. Although, generally no catalyst is required to promote sulfurization of any carbon-to-carbon double bond unsaturation which may be present in any tertiary amine reactant useful in preparing the organo-borate compositions of this invention, catalysts may be employed, if desired. If such catalysts are employed, preferably such catalysts are tertiary hydrocarbon substituted amines, most preferably, trialkylamines. Representative examples of which include tributylamine, dimethyloctylamine, triethylamine and the like.

The organo-borate additive friction modifiers can be prepared by adding the boron reactant, preferably boric acid, to at least one of the above defined tertiary amine reactants, in a suitable reaction vessel, and heating the resulting reaction mixture at a temperature ranging from about 50° to about 300° C. with continuous stirring. The reaction is continued until by-product water ceases to evolve from the reaction mixture indicating completion of the reaction. The removal of by-product water is facilitated by either blowing an inert gas, such as nitrogen, over the surface of the reaction mixture or by conducting the reaction at reduced pressures. Preferably the reaction between the boron reactant and the tertiary amine will be carried out at temperatures ranging from about 100° C. to about 250° C., and most preferably between about 150° C. and 230° C. while blowing with nitrogen.

Although normally the amines will be liquid at room temperature, in those instances where the amine reactant is a solid or semi-solid, it will be necessary to heat the amine to above its melting point in order to liquify it prior to the addition of the boron-containing reactant thereto. Those of ordinary skill in the art can readily determine the melting point of the amine either from the general literature or through a simple melting point analysis.

Generally, the amine reactant alone will serve as the solvent for the reaction mixture of the boron containing reactant and amine reactant. However, if desired, an inert normally liquid organic solvent can be used such as mineral oil, naphtha, benzene, toluene or xylene can be used as the reaction media. Where the organo-borate additive compound is to be added directly to a lubricating oil, it is generally preferred to conduct the reaction merely using the amine reactant as the sole solvent.

The borated fatty acid esters of glycerol are prepared by borating a fatty acid ester of glycerol with boric acid with removal of the water of reaction. Preferably, there is sufficent boron present such that each boron will react with from 1.5 to 2.5 hydroxyl groups present in the reaction mixture.

The reaction may be carried out at a temperature in the range of 60° C. to 135° C., in the absence or presence of any suitable organic solvent such as methanol, benzene, xylenes, toluene, neutral oil and the like.

Fatty acid esters of glycerol can be prepared by a variety of methods well known in the art. Many of these esters, such as glycerol monooleate and glycerol tallowate, are manufactured on a commercial scale. The esters useful are oil-soluble and are preferably prepared from $C_8$ to $C_{22}$ fatty acid or mixtures thereof such as are found in natural products. The fatty acid may be saturated or unsaturated. Certain compounds found in acids from natural sources may include licanic acid which contains one keto group. Most preferred $C_8$ to $C_{22}$ fatty acids are those of the formula RCOOH wherein R is alkyl or alkenyl.

The fatty acid monoester of glycerol is preferred, however, mixtures of mono- and diesters may be used. Preferably any mixture of mono- and diester contains at least 40% of the monoester. Most preferably, mixtures of mono- and diesters of glycerol contain from 40 to 60 percent by weight of the monoester. For example, commercial glycerol monooleate contains a mixture of from 45% to 55% by weight monoester and from 55% to 45% diester.

Preferred fatty acids are oleic, stearic, isostearic, palmitic, myristic, palmitoleic, linoleic, lauric, linolenic, and eleostearic, and the acids from the natural products tallow, palm oil, olive oil, peanut oil, corn oil, neat's foot oil and the like. A particularly preferred acid is oleic acid. The borated fatty acid esters are conveniently stabilized against hydrolysis by reacting the esters with an alkyl or alkenyl mono- or bis-succinimide.

Additional ingredients which may be included in the manual transmission fluid of the present invention are fatty acid amides which are useful as additional friction modifiers, particularly for reducing the static coefficient of friction.

A sulfurized olefin is included in the present invention as a friction modifier which also functions as an extreme pressure agent. Extreme pressure agents are materials which retain their character and prevent metal to metal damage, e.g., contact, when gears are engaged and meshed. The sulfurization of olefins is generally known as is evidenced by U.S. Pat. No. 4,191,659 as previously disclosed.

The sulfurized olefins which are useful in the present invention are those materials formed from olefins which been reacted with sulfur. Thus, an olefin is defined as a compound having a double bond connecting two aliphatic carbon atoms. In its broadest sense, the olefin may be defined by the formula $R^1R^2C{=}CR^3R^4$, wherein each of $R^1$, $R^2$, $R^3$ and $R^4$ is hydrogen or an organic radical. In general, the R values in the above formula which are not hydrogen may be satisfied by such groups as $-C(R^5)_3$, $-COOR^5$, $-CON(R^5)_2$, $-COON(R^5)_4$, $-COOM$, $-CN$, $-C(R^5){=}C(R^5)_2$, $-C(R^5){=}Y-X$, $-YR^5$ or $-Ar$.

Each $R^5$ is independently hydrogen, alkyl, alkenyl, aryl, substituted alkyl, substituted alkenyl or substituted aryl, with the proviso that any two $R^5$ groups can be alkylene or substituted alkylene whereby a ring of up to about 12 carbon atoms is formed;

M is one equivalent of a metal cation (preferably Group I or II, e.g., sodium, potassium, magnesium, barium, calcium);

X is halogen (e.g., chloro, bromo, or iodo);

Y is oxygen or divalent sulfur; and

Ar is an aryl or substituted aryl radical of up to about 12 carbon atoms.

Any two of $R^1$, $R^2$, $R^3$ and $R^4$ may also together form an alkylene or substituted alkylene group; i.e., the olefinic compound may be alicyclic.

The nature of the substituents in the substituted moieties described above are not normally a critical aspect of the invention and any such substituent is useful so long as it is, or can be made compatible, with lubricating environments and does not interfere under the contemplated reaction conditions. Thus, substituted compounds which are so unstable as to deleteriously decompose under the reaction conditions employed are not contemplated. However, certain substituents such as keto or aldehydo can desirably undergo sulfurization. The selection of suitable substituents is within the skill of the art or may be established through routine testing. Typical of such substituents include any of the above-listed moieties as well as hydroxy, amidine, amino, sulfonyl, sulfinyl, sulfonate, nitro, phosphate, phosphite, alkali metal mercapto and the like.

The olefinic compound is usually one in which each R value which is not hydrogen is independently alkyl, alkenyl or aryl, or (less often) a corresponding substituted radical. Monoolefinic and diolefinic compounds, particularly the former, are preferred, and especially terminal monoolefinic hydrocarbons; that is, those compounds in which $R^3$ and $R^4$ are hydrogen and $R^1$ and $R^2$ are alkyl or aryl, especially alkyl (that is, the olefin is aliphatic). Olefinic compounds having about 3 to 30 and especially about 3 to 18 (most often less than 9) carbon atoms are particularly desirable.

Isobutene, propylene and their oligomers such as dimers, trimers and tetramers, and mixtures thereof are especially preferred olefinic compounds. Of these compounds, isobutylene and diisobutylene are particularly desirable because of their availability and the particularly desirable because of their availability and the particularly high sulfur-containing compositions which can be prepared therefrom.

The sulfurization of such compounds is conducted as is known in the art and thus no further discussion of the sulfurized olefin component is given at this point.

Various sulfurized olefins which are useful in the present invention are shown in Table I below:

TABLE I

| Example | Olefinic compound | Molar ratio[1] | Temp., °C. | % sulfur in product |
|---|---|---|---|---|
| (a) | Isobutene; 1-butene[2] | 1:1:0.5 | 171 | 46.9 |
| (b) | 1-Octene | 1:1.5:0.5 | 171 | 34.3 |
| (c) | Isobutene; 1-octene[3] | 1:1:0.5 | 171 | 44. |
| (d) | Diisobutene | 1:1.5:0.5 | 171 | 41. |
| (e) | $C_{16}$–$C_{18}$ a-olefin | 1:1.5:0.5 | 171 | 20.6 |
| (f) | Cyclohexene | 1:1:0.5 | 171 | 31.8 |
| (g) | Isobutene; 1-hexene[2] | 1:1:0.5 | 171 | 39.5 |
| (h) | Methyl oleate | 1:1.5:0.5 | 171 | 16.5 |
| (i) | a-Methylstyrene | 1:1:0.5 | 171 | 39.2 |
| (j) | Isobutene; butadiene[3] | 1:1:0.5 | 171 | 47.2 |
| (k) | Polyisobutene[4] | 1:1.5:0.5 | 171 | 2.6 |
| (l) | Triisobutene[5] | 1:1.5:0.5 | 171 | — |
| (m) | 1-Butene | 1:1:0.5 | 138–171 | 49.5 |
| (n) | Isodecyl acrylate | 1:0.5:0.5 | 171 | 13.1 |
| (o) | Diels-Alder adduct of butadiene and butyle acrylate | 1:1.5:0.5 | 171 | 25.1 |
| (p) | 2-Butene[6] | 1:1:0.5 | 171 | 48.9 |
| q) | Turpentine | 1:1.5:0.5 | 171 | 39.2 |

[1]Olefinic compound(s):S:$H_2S$.
[2]1:1 molar ratio.
[3]0.9:0.1 molar ratio.
[4]Number average molecular weight of about 1000 as determined by vapor pressure osmometry.
[5]No separation step.
[6]Cis and trans isomers.

The amount of the friction modifier employed in the transmission fluids of the present invention is typically from about 0.1% to about 5%, preferably from about 0.25% to about 4%, and most preferably from about 0.5% to about 3.5% by weight of the total composition.

A preferred lubricant base for use herein is mineral oil. The term mineral oil is used in its conventional definition. The synthetic lubricating oils useful herein include hydrocarbon oils and halosubstituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diphenyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy- or polyaryloxy-silane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl)silicate, hexyl(4-methyl-2-pentoxy)-disiloxane, poly(methyl)siloxanes, poly(methylphenyl)-siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Polyolefin oligomers are typically formed by the polymerization reaction of alpha-olefins. Nonalpha-olefins may be oligomerized to give a synthetic oil within the present invention, however, the reactivity and availability of alpha-olefins at low cost dictates their selection as the source of the oligomer.

The polyolefin oligomer synthetic lubricating oils of interest in the present invention include hydrocarbon oils and halo-substituted hydrocarbon oils such as are obtained as the polymerized and interpolymerized olefins, e.g., oligomers, include the polybutylenes, polypropylenes, propylene-isobutylene copolymers, chlorinated polybutylenes, poly(1-hexenes), poly(1-octenes), poly(1-decenes), similar materials and mixtures thereof.

Typically, the oligomer is obtained from a monomer containing from about 6 to 18 carbon atoms, preferably from about 8 carbon atoms to about 12 carbon atoms. Most preferably, the monomer used to form the oligomer is decene, and preferably 1-decene. The nomenclature alpha-olefin is a trivial name and the IUPAC nomenclature of a 1-ene compound may be considered to have the same meaning within the present invention.

While it is not essential that the oligomer be formed from an alpha-olefin, such is desirable. The reason for forming the oligomer from an alpha-olefin is that branching will naturally occur at the points where the olefin monomers are joined together and any additional branching within the backbone of the olefin can provide too high a viscosity of the end oil. It is also desirable that the polymer formed from the alpha olefin be hydrogenated. The hydrogenation is conducted according to known practices. By hydrogenating the polymer free radical attack on the allyic carbons remaining after polymerization is minimized.

The molecular weight of the oligomer is typically averages from about 250 to about 1400, conveniently from about 280 to about 1200 preferably from about 300 to about 1100 and most preferably about 340 to about 520. The choice of molecular weight of the oligomer is largely dependent upon whether a viscosity improver is included within the formulation. That is, the polyolefin oligomer, may require either a thickening or a thinning effect to ensure that the proper lubricating viscosities are maintained under extreme heat and cold conditions.

A further desirable synthetic lubricant is an alkylated aromatic compound. The alkylated aromatic compounds are particularly beneficial in improving the low temperature flow characteristics. The alkylated aromatics may be referred to, supra, under the discussion of the alkaline earth metal salt. The alkylated aromatics are the same base materials utilized to manufacture the aromatic sulfonate.

The alkylated aromatic compound may be obtained in mixture with the sulfonate due to incomplete sulfonation of the alkylated aromatic. Of course, the alkylated aromatic may be obtained directly. Preferably, the aromatic nucleus of the alkylated aromatic compound is benzene. A particularly useful synthetic lubricant is a mixture of the alpha olefin oligomer and the alkylated aromatic. Typically, a mixture of the oligomer to the alkylated aromatic will be at a weight ratio of about 8:1 to about 1:8.

The amount of the oil of lubricating viscosity which is employed in the present invention is typically about 0.1% to about 98%, preferably about 4% to about 98%, with intermediate ranges of about 7% to about 96%, and about 5% to about 95% by weight of the composition. The products herein are conveniently obtained at from 95% to 50% by weight of the composition and the oil of lubricating viscosity is obtained at 5% to 50% by weight of the composition. The products are then diluted out by the customer to the final specifications.

Several additional components are desirably added to the manual transmission fluids of the present invention. Viscosity improving materials as previously referred to may be included in the compositions of the present invention. The viscosity index improvers typically include polymerized and copolymerized alkyl methacrylates and mixed esters of styrene-maleic anhydride interpolymers reacted with nitrogen-containing compounds.

Polyisobutylene compounds are also typically used as viscosity index improvers. The amount of viscosity improver which may be typically added to the fully formulated manual transmission fluid composition is about 1% to about 50%, preferably about 10% to about 25% by weight.

A water tolerance fixer is desirably included herein at a level 0.1 part to 5 parts per 100 parts of the oil. A suitable fixer is the reaction product obtained by reacting reactant (A) with reactant (B), wherein (A) is selected from the group consisting of:

$$RHC(COOH)CH_2COOH$$

and the anhydride of (A)

$$RH\ CCOOCOC\ H_2$$

wherein R is hydrocarbyl containing a sufficient number of carbons to provide for oil solubility of the reaction product; and (B) is selected from the group of compounds represented by:

$$R^2(R^3)NR^1OH$$

wherein $R^1$ is hydrogen or an alkylene moiety containing 1 to 4 carbons and $R^2$ and $R^3$ are each an alkyl moiety containing 1 to 4 carbon atoms. These products are described in the applicant Tipton's corresponding U.S. application docket number 2339 filed Nov. 18, 1986.

Zinc salts are also added to manual transmission lubricants. Zinc salts are ordinarily utilized as anti-wear agents such as zinc dithiophosphates. The zinc salts are added at levels measured by weight of the zinc metal at from about 0.02% to about 0.2%, preferably from about 0.04% to about 0.15% by weight.

Further useful components herein include seal swell agents such as sulfones and sulfolanes. Suitable seal swell agents are disclosed in U.S. Pat. No. 4,029,587 to Koch issued June 14, 1977. A still further useful component in the present invention is a foam suppression agent such as a silicone oil. Any other typical ingredient may be included herein such as pour point depressants, dyes, odorants and the like.

A particular utility of the products of the present invention is that they are highly effective in having a high dynamic, and a low static coefficient of friction. The use of boron in the friction modifier component results in reducing the static coefficient of friction and in the boron being delivered at a more effective rate to the metal surfaces. However, the boron in the friction modifier reduces the dynamic coefficient of friction which is not desirable. The use of the boronated overbased salt results in the dynamic coefficient of friction being substantially increased. Thus, the placement of boron in both components (a) and (b) is highly desirable. The products herein are also of relatively low viscosity at temperatures of −25° C. and thus shift easily.

The products herein are primarily designed for manual transmission fluids although they may be used, where appropriate, for hydraulic fluids and other functional fluids.

The following are suggested examples of the present invention.

EXAMPLE I

A manual transmission fluid is prepared by combining the following ingredients:

- 56.5 parts of mineral oil.
- 20 parts of a polyisobutylene having an average molecular weight (Mw) of approximately 1700.
- 15 parts of an alkylated benzene wherein the average alkyl chain is approximately 12 carbon atoms.
- 1 part of a maleic anhydride-styrene copolymer esterified as a pour point depressant.
- 100 ppm foam inhibitor which is a polydimethyl siloxane.
- 2.38 parts zinc dithiophosphate.
- 0.75 part dioleylphosphite.
- 1 part sulfurized olefin based on a mixture of 35 parts $C_{16-18}$ alpha olefin, 63% soya oil and 2% oleic acid where the mixture has a sulfur content of 10% by weight.
- 0.25 part fatty acid amide (oleyl)
- 0.3 part seal swell agent.
- 3.75 parts borated sodium carbonate overbased sodium alkyl benzene sulfonate where the alkyl contains 24 carbon atoms on average.
- 0.31 part of the reaction product of a polyisobutenyl succinic anhydride with an ethoxylated amine.

The product herein has a high dynamic coefficient of friction and a low static coefficient of friction. Cold weather viscosity is such that shifting is easily accomplished.

EXAMPLE II

A manual transmission fluid is prepared by combining the following ingredients:

- 56.5 parts of a poly alpha-olefin based on 1-decene monomer.
- 20 parts of a polyisobutylene having an average molecular weight (Mw) of approximately 1700.
- 15 parts of an alkylated benzene wherein the average alkyl chain is approximately 12 carbon atoms.
- 1 part of a maleic anhydride-styrene copolymer esterified as a pour point depressant.
- 100 ppm foam inhibitor which is a polydimethyl siloxane.
- 2.38 parts zinc dithiophosphate.
- 0.5 part borated fatty ($C_{16}$) epoxide.
- 1 part sulfurized olefin of Example I.
- 0.25 part fatty amide.
- 3.0 parts calcium alkyl benzene sulfonate (overbased) wherein the alkyl contains about 24 carbon atoms on average.
- 1.0 part of the boronated sodiumm carbonate overbased sodium sulfonate of Example I.

The product herein has a high dynamic coefficient of friction and a low static coefficient of friction. Cold weather viscosity is such that shifting is easily accomplished.

EXAMPLE III

A manual transmission fluid is prepared by combining the following ingredients:

56.5 parts of mineral oil.
20 parts of a polyisobutene having an average molecular weight (Mw) of approximately 1700.
15 parts of an alkylated benzene wherein the average alkyl chain is approximately 12 carbon atoms.
1 part of a maleic anhydride-styrene copolymer esterified as a pour point depressant.
100 ppm foam inhibitor which is a polydimethyl siloxane.
1.0 part zinc dithiophosphate
1 part sulfurized olefin based on Example I
0.25 part fatty amide
3.5 parts calcium sulfur coupled alkyl ($C_{12}$) phenate overbased to 200 total base number.
1.0 part borated sodium carbonate overbased sodium alkyl benzene sulfonate from Example I.
1.0 part glycerol monooleate (borated).

The product herein has a high dynamic coefficient of friction and a low static coefficient of friction. Cold weather viscosity is such that shifting is easily accomplished.

EXAMPLE IV

A manual transmission fluid is prepared by combining the following ingredients:

56.5 parts of a poly alpha-olefin based on 1-decene monomer.
20 parts of a polyisobutylene having an average molecular weight (Mw) of approximately 1700.
15 parts of an alkylated benzene wherein the average alkyl chain is approximately 12 carbon atoms.
1 part of a maleic anhydride-styrene copolymer esterified as a pour point depressant.
100 ppm inhibitor which is a polydimethyl siloxane.
1.0 part zinc dithiophosphate.
0.75 part dioleylphosphite.
1 part sulfurized olefin based on Example I.
0.25 part fatty amide.
3.5 parts magnesium alkyl benzene sulfonate (overbased) wherein the alkyl contains about 24 carbon atoms on average.
1.0 part of the borated sodium carbonate overbased sodium sulfonate of Example I.

The product herein has a high dynamic coefficient of friction and a low static coefficient of friction. Cold weather viscosity is such that shifting is easily accomplished.

EXAMPLE V

A manual transmission fluid is prepared by combining the following ingredients:

56.5 parts mineral oil.
20 parts of a polymethacrylate having an average molecular weight (Mw) of approximately 50,000.
15 parts of an alkylated benzene wherein the average alkyl chain is approximately 12 carbon atoms.
1 part of a maleic anhydride-styrene copolymer esterified as a pour point depressant.
10 ppm foam inhibitor which is a polydimethyl siloxane.
2.38 parts zinc dithiophosphate
0.75 part dioleylphosphite
1 part sulfurized olefin based on a mixture of 35 parts $C_{16-18}$ alpha-olefin, 63% soya oil and 2% oleic acid where the mixture has a sulfur content of 10% by weight.
0.25 part fatty amide.
0.3 part seal swell agent.
3.75 parts borated sodium carbonate overbased sodium alkyl benzene sulfonate where the alkyl contains 24 carbon atoms on average.
0.31 part of the reaction product of a polyisobutenyl succinic anhydride with an ethoxylated amine.

The product herein has a high dynamic coefficient of friction and a low static coefficient of friction. Cold weather viscosity is such that shifting is easily accomplished.

What is claimed is:

1. A lubricant mixture suitable for a manual transmission fluid comprising:
(a) a boronated overbased alkali metal or alkaline earth metal salt selected from the group consisting of sulfonates, phenates, oxylates, carboxylates and mixtures thereof;
(b) a friction modifier selected from the group consisting of fatty phosphites, fatty acid amides, borated fatty epoxides, fatty amines, glycerol esters and their borated derivatives, borated alkoxylated fatty amines, sulfurized olefins and mixtures thereof;
(c) and an oil of lubricating viscosity.

2. The lubricant mixture of claim 1 wherein the friction modifier is a fatty phosphite.

3. The lubricant mixture of claim 1 wherein (a) is an alkali metal salt.

4. The lubricant mixture of claim 1 wherein the alkali metal salt is overbased with an alkali metal carbonate.

5. The lubricant mixture of claim 1 containing a zinc salt.

6. The lubricant mixture of claim 1 wherein the sulfonate contains an aromatic nucleus.

7. The lubricant mixture of claim 1 wherein (c) is mineral oil.

8. The lubricant mixture of claim 1 containing a viscosity improver.

9. The lubricant mixture of claim 3 wherein:
(a) the alkali metal salt is a sodium sulfonate salt present at about 0.5% to about 8% by weight;
(b) the friction modifier is a fatty phosphite present at about 0.1% to about 5% by weight;
(c) the lubricant is a polyolefin oligomer present at about 4% to about 98% by weight.

10. The lubricant mixture of claim 1 wherein the friction modifier is a sulfurized olefin.

11. The lubricant mixtur of claim 1 wherein the viscosity improver is a member selected from the group consisting of polyisobutylene, maleic anhydride-styrene copolymers and polymethacrylate and mixtures thereof.

12. The lubricant mixture of claim 1 containing a water tolerance fixer.

13. The lubricant mixture of claim 7 wherein the mineral oil is present at about 0.1% to about 95% by weight.

14. The lubricant mixture of claim 2 wherein the alkyl radicals in the fatty phosphite are substantially free of branching.

15. The lubricant mixture of claim 1 wherein both (a) and (b) contain a source of boron.

16. A concentrate containing about 95% to about 50% by weight of a mixture of (a), (b) and (c) wherein:

(a) is a borated overbased alkali metal or an alkaline earth metal salt selected from the group consisting of sulfonates, phenates, oxylates, carboxylates and mixtures thereof;

(b) is a friction modifier selected from the group consisting of fatty phosphites, fatty acid amides, borated fatty epoxides, fatty amines, glycerol esters and their borated derivatives, borated alkoxylated fatty amines, sulfurized olefins and mixtures thereof; and (c) from about 5% to about 50% by weight of an oil of lubricating viscosity.

17. A lubricant mixture suitable for a manual transmission fluid comprising:

(a) a boronated overbased alkali metal salt selected from the group consisting of sulfonates, phenates, oxylates, carboxylates and mixtures thereof;

(b) a friction modifier selected from the group consisting of fatty phosphites, fatty acid amines, borated fatty epoxides, fatty amines, glycerol esters and their borated derivatives, borated alkoxylated fatty amines, sulfurized olefins and mixtures thereof;

(c) and 0.1 to 98% by weight of the composition of an oil of lubricating viscosity.

* * * * *